US005988621A

United States Patent [19]

Kondo et al.

[11] Patent Number: 5,988,621

[45] Date of Patent: Nov. 23, 1999

[54] RECYCLE DOCUMENT FEEDER

[75] Inventors: Kazuhisa Kondo; Toru Tanjo; Hiroshi Kobayashi; Hiroyuki Harada; Masahiro Sako; Jun Kusakabe, all of Osaka, Japan

[73] Assignee: Mita Industrial Co., Ltd., Osaka, Japan

[21] Appl. No.: 08/998,817

[22] Filed: Dec. 29, 1997

[30] Foreign Application Priority Data

Jan. 17, 1997 [JP] Japan ..... 9-007012

[51] Int. Cl.[6] ..... B65H 5/22

[52] U.S. Cl. ..... 271/3.02; 271/3.04; 271/3.13; 271/3.15; 271/171; 271/223; 399/370; 399/373

[58] Field of Search ..... 399/370, 372, 399/373, 377, 376; 271/3.02, 3.04, 3.05, 3.13, 3.15, 3.16, 3.19, 171, 273, 274, 264, 301, 303, 220, 223

[56] References Cited

U.S. PATENT DOCUMENTS

| | | | |
|---|---|---|---|
| 4,935,780 | 6/1990 | Yamada et al. | 271/301 |
| 5,253,861 | 10/1993 | Schmaling | 271/273 |
| 5,797,597 | 8/1998 | Kakuta et al. | 271/276 |
| 5,822,673 | 10/1998 | Tanjo | 271/3.01 |
| 5,903,812 | 5/1999 | Kondoh et al. | 271/223 |

FOREIGN PATENT DOCUMENTS

| | | | |
|---|---|---|---|
| 360061428 | 4/1985 | Japan | 271/171 |
| 0233420 | 9/1990 | Japan | 271/171 |

*Primary Examiner*—H. Grant Skaggs
*Attorney, Agent, or Firm*—Smith, Gambrell & Russell, LLP; Beveridge, DeGrandi, Weilacher & Young Intellectual Property Group

[57] ABSTRACT

A recycle document feeder according to the present invention includes a pair of document width regulating guides (9*a*, 9*b*) for guiding opposite edges of document originals (D) fed back onto a document placing plate (8) for alignment thereof with respect to the width thereof. With this construction, if the document width regulating guides (9*a*, 9*b*) each had a small length (A) as measured along a document transportation direction, the document originals (D) fed back onto the document placing plate (8) could not properly be aligned by the document width regulating guides (9*a*, 9*b*) thereby to be randomly stacked on the skew with respect to the document transportation direction. In view of this, the document width regulating guides (9*a*, 9*b*) are constructed so as to guide the document originals fed back onto the document placing plate (8) from a document discharge portion (30) over a distance equivalent to or greater than 60% of the length of a smallest document original (as measured along the transportation direction) which is to be possibly transported by the recycle document feeder.

8 Claims, 5 Drawing Sheets

RECYCLE DOCUMENT FEEDER

This invention is based on applications No. 9-7012 filed in Japan, the contents of which is incorporated hereinto by reference.

BACKGROUND OF THE INVENTION

1. Field of the Invention

The present invention relates to a recycle document feeder which is mounted on an image forming apparatus such as a copying machine, a facsimile machine, an image reader or the like, and adapted to feed a document original to be read by the image forming apparatus from a document placing plate to a reading position and then back onto the document placing plate after image reading of the document original.

2. Description of Related Art

Recycle document feeders are conventionally known which are mounted on a copying machine, for example, and adapted to automatically feed a document original previously set on a document placing plate onto a contact glass of the copying machine and then back onto the document placing plate after image reading of the document original.

The recycle document feeders typically include a pair of document width regulating guides for positioning the document originals to be fed with respect to a direction perpendicular to a document transportation direction. The pair of document width regulating guides are slid so that a spacing therebetween is adjusted to conform to the width of the document originals, and then the document originals are placed on the document placing plate. Thus, the document originals are positioned with respect to the direction perpendicular to the document transportation direction.

Some of the recycle document feeders are adapted to slightly reciprocate the pair of document width regulating guides perpendicularly to the document transportation direction (or in a direction in which the document width regulating guides are slid) to align the document originals fed back onto the document placing plate with respect to the direction perpendicular to the document transportation direction. The slight reciprocation occurs every time a document original is fed back. Thus, the document originals fed back onto the document placing plate can smoothly be transported to a predetermined setting position for re-feeding thereof.

During the document transportation operation, however, the slight reciprocation of the document width regulating guides in the prior art document feeder causes an operation noise, which may grate upon user's ears.

In addition, the provision of a mechanism for slight reciprocation of the document width regulating guides complicates the construction of the document feeder, thereby increasing the costs of the feeder.

SUMMARY OF THE INVENTION

In order to solve the aforesaid problems, it is an object of the present invention to provide a recycle document feeder, without drastically increasing the costs, which can assuredly align document originals fed back onto a document placing plate with respect to a direction perpendicular to a document transportation direction without any operation noise.

In accordance with the present invention to achieve the aforesaid object, there is provided a recycle document feeder which is adapted to feed document originals previously set on a document placing plate one by one into a document transportation path and transport the document originals one by one through the transportation path and then back onto the document placing plate, and comprises a pair of document width regulating guides provided on the document placing plate in an opposed relation, spaced from each other in a document widthwise direction and each extending parallel to a transportation direction for positioning the document originals placed on the document placing plate with respect to the width of the document originals perpendicularly to the transportation direction and guiding the document originals fed back onto the document placing plate, the pair of document width regulating guides being adapted to guide the document originals fed back onto the document placing plate over a distance equivalent to or greater than 60% of the length of a smallest size document original to be possibly transported by the document feeder.

With this arrangement, the document originals fed back onto the document placing plate are guided by the pair of document width regulating guides so as to be aligned with respect to the direction perpendicular to the transportation direction. Since the document width regulating guides are kept stationary, the operation noise can be eliminated which may otherwise be caused when the document originals are jogged in the document widthwise direction for alignment thereof in the prior art.

The pair of document width regulating guides are constructed so as to guide a document original over a distance equivalent to or greater than 60% of the length of the document original as measured from the leading edge thereof. Therefore, the document originals can assuredly be aligned with respect to the width thereof. Thus, the document originals fed back onto the document placing plate can smoothly be transported to a predetermined setting position for re-feeding thereof.

DESCRIPTION OF THE PREFERRED EMBODIMENTS

A recycle document feeder for a copying machine will hereinafter be described in detail as one embodiment of the present invention. It should be understood that the present invention is not limited to the recycle document feeder for the copying machine, but is applicable to a recycle document feeder for a facsimile machine and a recycle document feeder for an image reader to be connected to a computer and the like.

Figure 1:
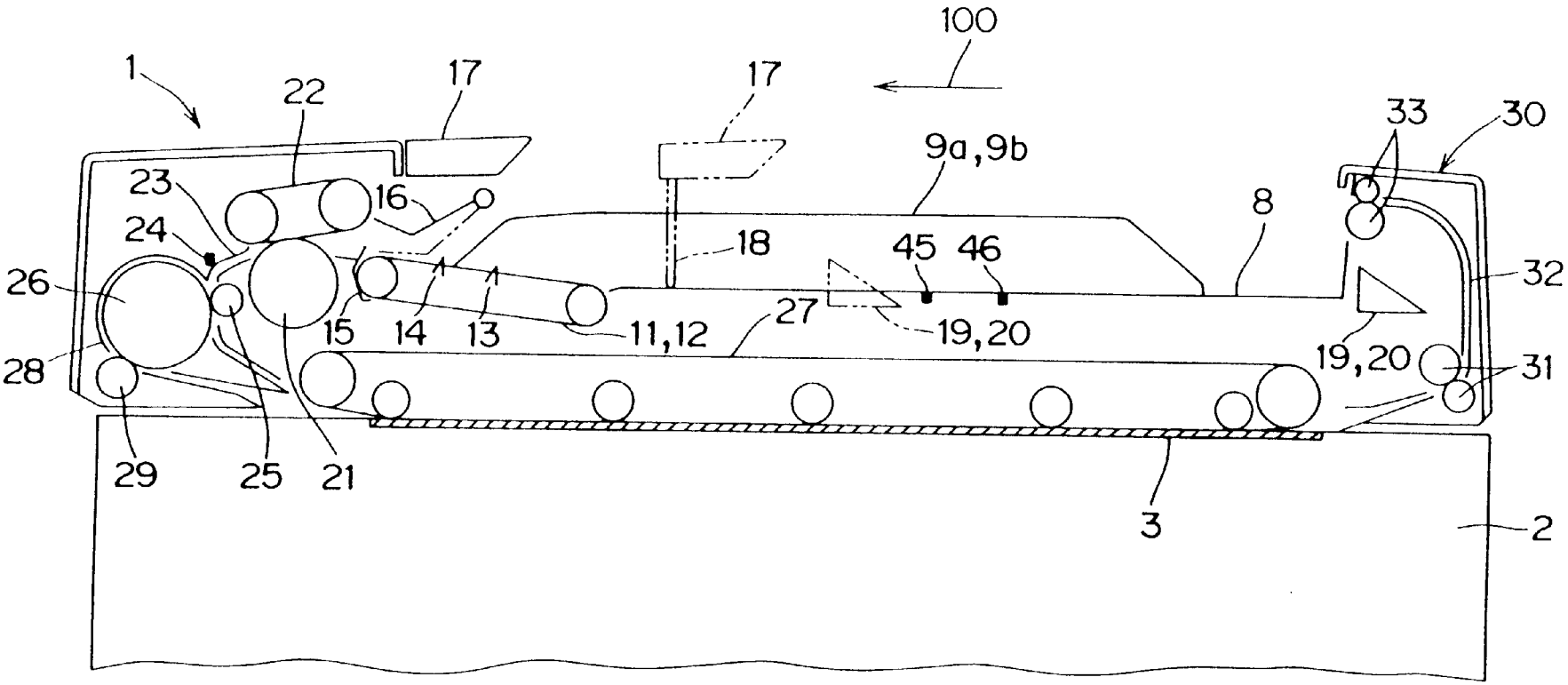
FIG. 1 is a sectional view schematically illustrating the internal construction of a recycle document feeder according to one embodiment of the present invention as viewed from its front side.
Figure 2:
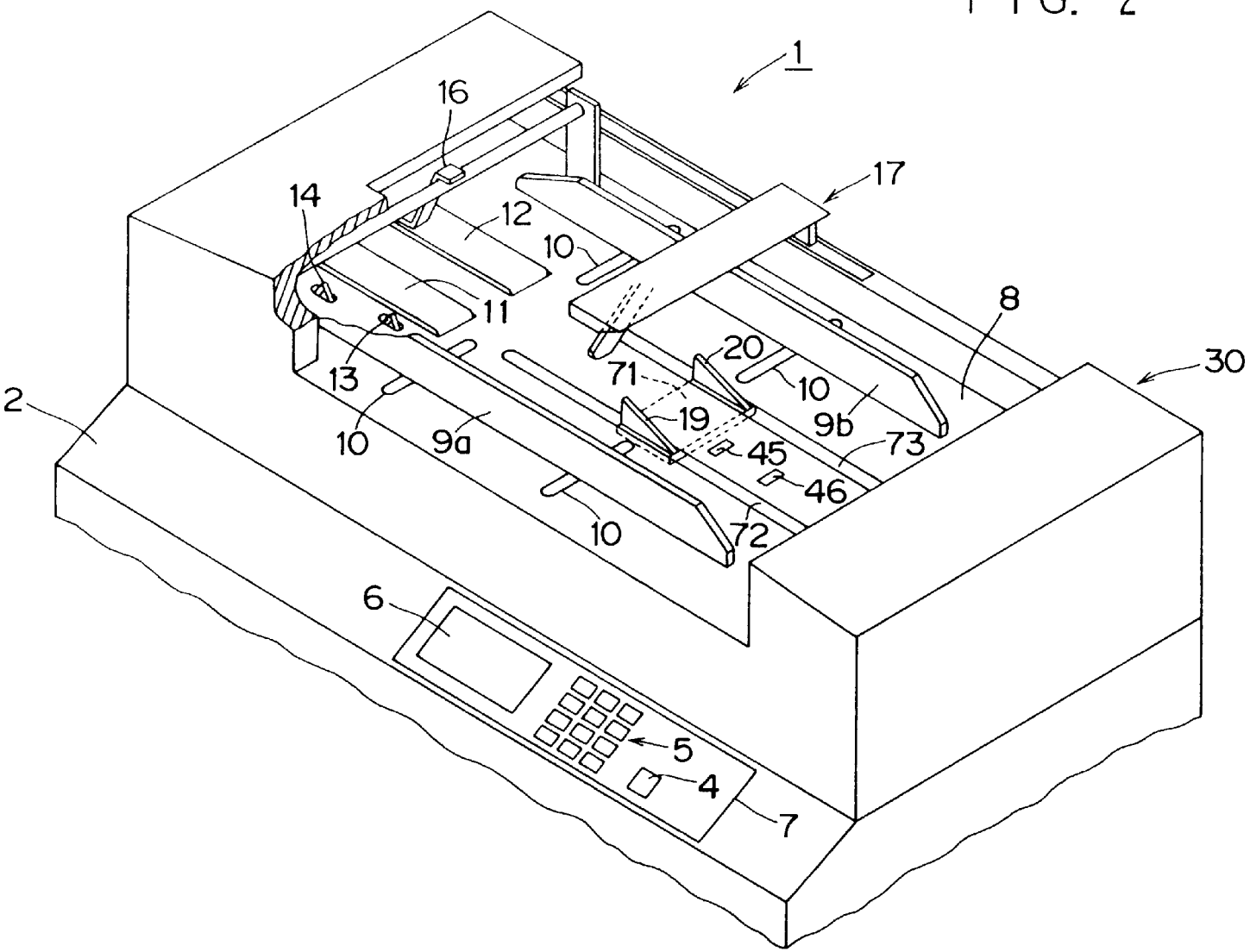
FIG. 2 is a partially cut away perspective view of the recycle document feeder shown in FIG. 1.

FIG. 1 is a sectional view schematically illustrating the inside construction of the recycle document feeder according to the embodiment of the present invention as viewed from its front side. FIG. 2 is a partially cutaway perspective view of the recycle document feeder shown in FIG. 1.

Referring generally to FIG. 1 and occasionally to FIG. 2, the recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3. The recycle document feeder 1 also serves as a cover of the contact glass 3, which is adapted to be opened upward pivotally about the rear edge of the recycle document feeder 1 to expose the contact glass 3 on which a document original can manually be placed.

Provided on a front top face of the copying machine body 2 is an operation panel 7 having operation keys such as a print key 4 and ten-keys 5 and a display portion 6 arranged thereon. The copying machine body 2 and the recycle document feeder 1 are operated through the operation panel 7.

A document placing plate 8 for holding thereon a stack of document originals to be fed onto the contact glass 3 is provided in the center of the upper face of the recycle document feeder 1. The document placing plate 8 is capable of accepting document originals having a A5 (JIS Column A No. 5) size to an A3 (JIS Column A No. 3) size, for example. On the document placing plate 8 is provided a pair of document width regulating guides 9*a* and 9*b* for positioning the stack of document originals placed on the document placing plate 8 relative to a direction perpendicular to a document feeding direction (relative to the width of the document stack) and guiding the document originals fed back onto the document placing plate 8. The document width regulating guides 9*a* and 9*b* are adapted to be moved toward and away from each other along a rail 10 in an interlocked relation, and is manually operated so as to conform to the width of the document stack placed on the document placing plate 8.

A mechanism for moving the document width regulating guides 9*a* and 9*b* linked with each other will be detailed later.

Two feed belts 11 and 12 for guiding the stack of document originals placed on the document placing plate 8 to a predetermined setting position and starting the feeding of the document originals are provided adjacent to the document placing plate 8. More specifically, the two feed belts 11 and 12 are disposed in a parallel relation perpendicular to the document transportation direction as shown in FIG. 2.

A preset switch 13 for sensing that the document originals are placed on the document placing plate 8 is provided on an upstream side of the feed belt 11. When a user places a stack of document originals on the document placing plate 8, the preset switch 13 is turned on to start driving the feed belts 11 and 12. The stack of document originals placed on the document placing plate 8 is transported in the direction of an arrow 100 (leftward as seen in FIG. 1) by the driving of the feed belts 11 and 12.

A set switch 14 is provided downstream of the preset switch 13 relative to the document transportation direction. The driving of the feed belts 11 and 12 are stopped after a lapse of a predetermined time period from a time point at which the set switch 14 is turned on by the transported document stack. Thus, the stack of document originals is set in the predetermined setting position.

A leading edge stopping member 15 for stopping the leading edges of the document originals set in place is provided downstream of the feed belts 11 and 12 to prevent the document originals from being inserted downstream of the setting position in the document transportation direction. Further, the leading edge stopping member 15 prevents a user unfamiliar with the handling of the document feeder from inadvertently inserting document originals downstream of the setting position in the document transportation direction.

When the print key 4 on the copying machine body 2 is pressed with the document originals thus set in place, a partitioning unit 17 previously located in its home position (as indicated by a solid line in FIG. 1) above the feed belts 11 and 12 is moved in a direction opposite to the document transportation direction by a certain distance corresponding to the size of the document originals so as to be located in a position as indicated by a two-dot-and-dash line in FIG. 1. The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of document originals fed back onto the document placing plate 8 through a document discharge portion 30 (which will be described later) are aligned and the document originals subjected to the document feeding operation are divided from the document originals yet to be subjected to the document feeding operation.

Further, two action plates 19 and 20 previously located in their home positions (as indicated by a solid line in FIG. 1) within the document discharge portion 30 are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8 (see FIG. 2), and adapted to be moved in unison along guide rails 72 and 73 extending in a direction perpendicular to the document transportation direction in a spaced relation on the document placing plate 8.

The action plates 19 and 20 are each comprised of a generally right-angled triangular planar plate having an edge inclined upward toward the document transportation direction as viewed in a direction perpendicular to the direction of their movement. Therefore, a first document original is guided by the inclined edges of the action plates 19 and 20 and to be fed back onto the document placing plate 8 so that the leading edge of the document original is prevented from bumping against the trailing edges of the document originals set in the setting position and rested thereon.

A mechanism for sensing the size of the document originals and a driving mechanism for driving the partitioning unit 17 and the action plates 19 and 20 will be detailed later.

A pressing member 16 provided above the feed belt 12 is shifted from an upper position as indicated by a solid line to a lower position as indicated by a two-dot-and-dash line in FIG. 1 thereby to press the leading edge of the document stack set in the setting position against the feeding belt 12. The leading edge stopping member 15 is lowered, and the driving of the feed belts 11 and 12 is then started to make the document feeding operation.

A separator roller 21 is disposed downstream of the leading edge stopping member 15 relative to the document transportation direction, and a separator belt 22 is opposed to the separator roller 21. The lowermost one of the document originals (might be of multiple) fed by the feed belts 11 and 12 is separated from the other document originals and fed into a document transportation path 23.

The document original fed into the document transportation path 23 reaches a resist switch 24 provided in the document transportation path 23 thereby to turn on the resist switch 24. After a lapse of a predetermined time period from the turn-on of the resist switch 24, the driving of the feed belts 11 and 12, the separator roller 21 and the separator belt 22 is stopped. At this time, the leading edge of the document original fully abuts against a nipping position between a resist roller 25 and a resist/reverse roller 26, whereby the leading edge portion of the document original has a certain degree of slack. This prevents the document original from being transported at an angle with respect to the document transportation path 23 (so-called slant document feeding).

Thereafter, the transportation of the document original is resumed by starting the rotative driving of the resist roller 25 and the resist/reverse roller 26 in association with the operation of the copying machine body 2. The resist roller 25 and the resist/reverse roller 26 are rotated at a relatively low speed within a predetermined time period after the start of the driving thereof and, thereafter, rotated at a relatively high speed. The predetermined time period for the low-speed rotation is defined as a time period sufficient to absorb the slack of the leading edge portion of the document original. Since the slack of the leading edge portion of the document original is gradually eliminated, an audible sound which may be generated when the slack leading edge portion is abruptly stretched taut (a pop which may be generated when paper is abruptly tensed) is not generated.

The document original transported by the resist roller 25 and the resist/reverse roller 26 is placed in a predetermined position on the contact glass 3 of the copying machine body 2 by a transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, the resist/reverse roller 26, a reverse roller 29 and the resist roller 25, and placed on the contact glass 3 again by the transportation belt 27. At this time, the back side of the document original is faced with the contact glass 3. Then, the document original is subjected to the image reading operation by the copying machine so that the image on the back side of the document original is first read. Thereafter, the document original is reversed again, and the image on the front side of the document original is read.

The document original subjected to the image reading operation is transported to the document discharge portion 30 by the transportation belt 27. The document original transported to the document discharge portion 30 is further transported through a discharging path 32 by a discharge roller pair 31, and then discharged onto the document placing plate 8 by a discharged roller pair 33. Thus, the document original subjected to the image reading operation is fed back onto the document placing plate 8.

Figure 3:
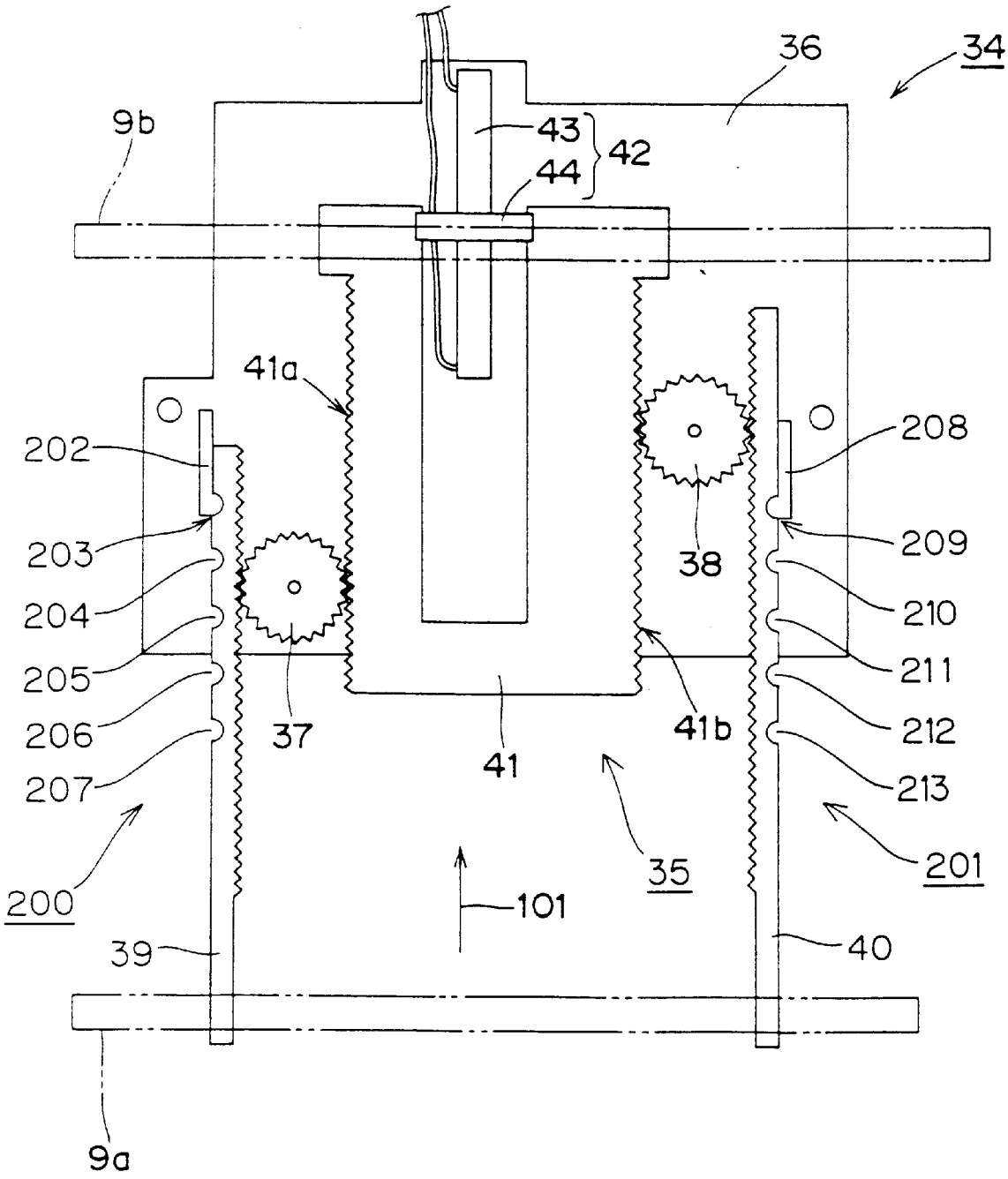
FIG. 3 is a plan view illustrating a document width sensing mechanism for sensing the width of a document original.

FIG. 3 is a plan view of the document width sensing mechanism for sensing the width of the document originals set in place.

The document width sensing mechanism 34 is provided below the document placing plate 8, and adapted to determine the size (width) of the document originals on the basis of the stop position of the document width regulating guides 9*a* and 9*b*. The document width sensing mechanism 34 includes a slide mechanism 35 for sliding the document width regulating guides 9*a* and 9*b* interlocked with each other, and a document width sensor 42 adapted to output a voltage in accordance with the stop position of the document width regulating guide 9*b*.

The slide mechanism 35 includes a base 36 fixed to the document placing plate 8, first and second pinions 37 and 38 provided on the base 36 and spaced a predetermined distance in a direction perpendicular to the direction of an arrow 101, a rack 39 geared with the first pinion 37, a rack 40 geared with the second pinion 38, and an interlocking plate 41 disposed between the first pinion 37 and the second pinion 38, being geared with both pinions 37 and 38.

The document width regulating guide 9*a* is attached to end portions of the racks 39 and 40 on one side thereof as spanning across the racks 39 and 40. The racks 39 and 40 slide on the upper surface of the base 36 in association with the sliding of the document width regulating guide 9*a*. The document width regulating guide 9*b* is attached to one end of the interlocking plate 41, which slides on the upper surface of the base 36 in association with the sliding of the document width regulating guide 9*b*.

Opposite edges of the interlocking plate 41 relative to the direction perpendicular to the direction of the arrow 101 are respectively formed with gearing surfaces 41*a* and 41*b*, which are geared with the first and second pinions 37 and 38, respectively. More specifically, the rack 39 and the gearing surface 41*a* of the interlocking plate 41 are opposed to each other to be geared with the first pinion 37. The rack 40 and the gearing surface 41*b* of the interlocking plate 41 are opposed to each other to be geared with the second pinion 38.

With this construction, when the document width regulating guide 9*a* is slid toward the document width regulating guide 9*b*, for example, the racks 39 and 40 slide in the direction of the arrow 101 in association with the sliding of the document width regulating guide 9*a*. Thus, the first pinion 37 is rotated clockwise as seen in FIG. 3, while the second pinion 38 is rotated counterclockwise as seen in FIG. 3. Since the interlocking plate 41 is slid in a direction opposite to the direction of the arrow 101 by the rotation of the first and second pinions 37 and 38, the document width regulating guide 9*b* is moved toward the document width regulating guide 9*a*.

Conversely, when the document width regulating guide 9*b* is slid away from the document width regulating guide 9*a*, for example, the interlocking plate 41 slides in the direction of the arrow 101 in association with the sliding of the document width regulating guide 9*b*. Thus, the first pinion 37 is rotated counterclockwise as seen in FIG. 3, while the second pinion 38 is rotated clockwise as seen in FIG. 3. Since the racks 39 and 40 are slid in a direction opposite to the direction of the arrow 101 by the rotation of the first and second pinions 37 and 38, the document width regulating guide 9*a* is moved away from the document width regulating guide 9*b*.

Thus, when either one of the document width regulating guides 9*a* and 9*b* is slid toward or away from the other, the other document width regulating guide slides toward or away from the one document width regulating guide in association with the sliding of the one document width regulating guide. Therefore, when the document originals are set along the document width regulating guides 9*a* and 9*b*, the widthwise center lines (center lines relative to the direction perpendicular to the document transportation direction) of the document originals set on the document placing plate 8 are always aligned in a same position regardless of the document size.

However, when the document width regulating guide 9*a* is slid in the direction of the arrow 101 by holding the upstream end (on the side of the rack 40) of the document width regulating guide 9*a*, the slide amount of the rack 40 may be greater than the slide amount of the rack 39, so that the document width regulating guide 9*a* is skewed with respect to the document transportation direction. This is because there are small gaps between the racks 39 and 40 and the slide rails. If the document width regulating guides 9*a* and 9*b* are skewed, the center line of the document originals set on the document placing plate 8 is skewed with respect to the transportation direction, so that the document original may be transported on the skew with respect to the transportation direction.

To prevent the document width regulating guides 9*a* and 9*b* from being skewed with respect to the document transportation direction, the slide mechanism 35 includes click mechanisms 200 and 201.

The click mechanism 200 includes an engagement claw 202 attached to a predetermined position on the base 36. The engagement claw 202 is a resilient member extending in the direction 101 of the sliding of the document width regulating guides 9*a* and 9*b* (perpendicularly to the document transportation direction) with the tip thereof kept in contact with the rack 39.

A plurality of engagement portions 203 to 207 to be engaged with the engagement claw 202 are formed on a face of the rack 39 opposite to a portion thereof interlocking with the first pinion 37. The engagement portions 203 to 207 are formed in such positions that the tip of the engagement claw 202 can be engaged therewith when the document width regulating guides 9*a* and 9*b* are slid by exact slide amounts corresponding to the respective document sizes.

The click mechanism 201 includes an engagement claw 208 attached to a predetermined position on the base 36 and engagement portions 209 to 213 formed on a face of the rack 40 opposite to a portion thereof interlocking with the second pinion 38, and has substantially the same construction as the click mechanism 200. Therefore, a detailed description will not be given thereto.

FIG. 3 illustrates a state, for example, where the spacing between the document width regulating guides 9*a* and 9*b* is adjusted to conform to an A3-size document original by sliding the document width regulating guides 9*a* and 9*b*. At this time, the tip of the engagement claw 202 is engaged with the engagement portion 204, while the tip of the engagement claw 208 is engaged with the engagement portion 210. When the document width regulating guides 9*a* and 9*b* are slid by an exact slide amount for an A5-size document original from the aforesaid state, the tip of the engagement claw 202 is disengaged from the engagement portion 204 to be moved with respect to the rack 39, and then engaged with the engagement portion 207. The tip of the engagement claw 208 is disengaged from the engagement portion 210 to be moved with respect to the rack 40, and then engaged with the engagement portion 213.

Thus, the spacing between the document width regulating guides 9*a* and 9*b* is determined by two positions at which the engagement claw 202 is engaged with one of the engagement portions 203 to 207 and the engagement claw 208 is engaged with one of the engagement portions 209 to 213. Therefore, the document width regulating guides 9*a* and 9*b* are prevented from being skewed with respect to the document transportation direction, even if the slide amount of either one of the racks 39 and 40 becomes greater than the slide amount of the other when the document width regulating guides 9*a* and 9*b* are slid to the positions corresponding to the document size. Accordingly, the document originals can assuredly be set on the document placing plate 8 along the document transportation direction.

When the engagement claw 202 and the engagement claw 208 are engaged with one of the engagement portions 203 to 207 and one of the engagement portions 209 to 213, respectively, the document width regulating guides 9*a* and 9*b* are made stationary in predetermined positions corresponding to the document size. Therefore, this arrangement is convenient for users.

In addition, the racks 39 and 40 are respectively biased against the pinions 37 and 38 by the resilient force of the engagement claws 202 and 208. Therefore, the racks 39 and 40 are prevented from warping apart from the pinions 37 and 38, respectively.

Although the plurality of engagement portions are formed on the racks 39 and 40 in this embodiment, the engagement portions may be formed on a plurality of resilient engagement arms which each extend along the slide direction from either one of the document width regulating guides 9*a* and 9*b*.

The document width sensor 42 includes a resistor 43 attached to a predetermined position on the base 36 and a contactor 44 to be slid on the resistor 43 in contact therewith. A predetermined voltage is constantly applied to the resistor 43, and the document width sensor 42 outputs a voltage which varies depending on the position of the contactor 44.

Therefore, as the document width regulating guide 9*b* is slid in accordance with the size of the document originals set on the document placing plate 8, the resistor 43 slides so that the document width sensor 42 outputs a voltage corresponding to the document size. Thus, the width of the document originals set on the document placing plate 8 can be sensed on the basis of the output voltage.

As described above, the slide mechanism 35 includes the click mechanisms 200 and 201 and, therefore, the document width regulating guides 9*a* and 9*b* can be slid to exact positions corresponding to the document size. Accordingly, a contactor 44 stops at exactly the same position whenever document originals of the same size are set on the document placing plate, so that the width of the document originals set on the document placing plate 8 can accurately be sensed.

Instead of the aforesaid variable resistance sensor, a variable capacity sensor may be used as the document width sensor 42, in which the capacity varies depending on the position of the document width regulating guide 9*b*. Alternatively, a plurality of photosensors may be employed as the document width sensor 42, which are adapted to sense the position of the document width regulating guide 9*b* on the basis of the outputs therefrom.

However, the stop position of the document width regulating guide 9*b* is the same where B5 size document originals are set in place with their length being perpendicular to the document transportation direction (so-called B5 longitudinal setting) and where B4 (JIS Column B No. 4) size document originals are set in place. Further, the stop position of the document width regulating guide 9*b* is the same where A4 (JIS column A No. 4) size document originals are set in place with their length being perpendicular to the document transportation direction (so-called A4 longitudinal setting)

and where A3 size document originals are set in place. Without any special consideration, it would be impossible to make a distinction between the B5 longitudinal setting and the B4 setting and between the A4 longitudinal setting and the A3 setting.

In view of this, two document length sensors 45 and 46, for example, comprised of reflective sensors are provide on the document placing plate 8 as shown in FIGS. 1 and 2. The document length sensor 45 is provided in such a position that it is turned on in the case of the B4 setting but not turned on in the case of the B5 longitudinal setting. The document length sensor 46 is provided in such a position that it is turned on in the case of the A3 setting but not turned on in the case of the A4 longitudinal setting.

Thus, all the sizes of document originals possibly set on the document placing plate 8 can be distinguished on the basis of the outputs of the document width sensor 42 and the document length sensors 45 and 46. That is, the document width sensor 42 and the document length sensors 45 and 46 constitute the document size sensing mechanism.

Where document sizes other than those specified by the Japanese Industrial standards (JIS), such as U.S. document sizes and EP document sizes are to be sensed by the document size sensing mechanism, a greater number of document length sensors may be employed.

Figure 4:
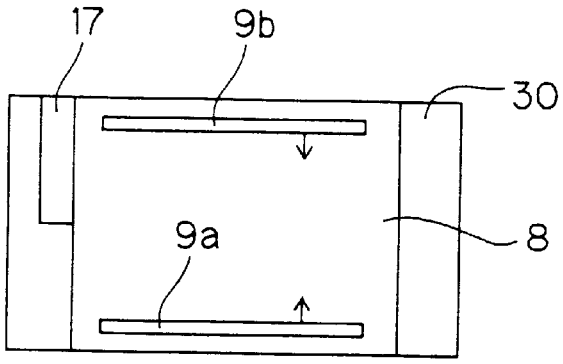
FIGS. 4(*a*) to 4(*e*) are schematic diagrams illustrating an operation of the recycle document feeder.
Figure 4:
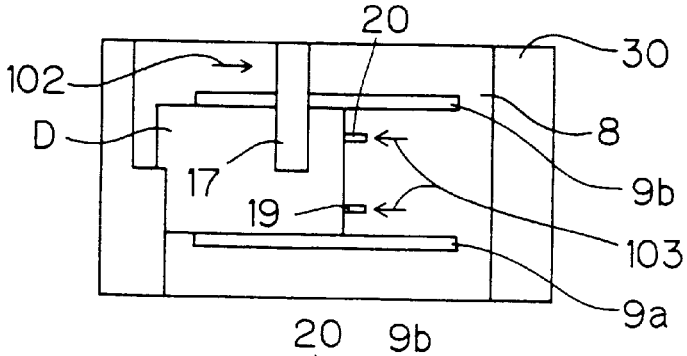
Figure 4:
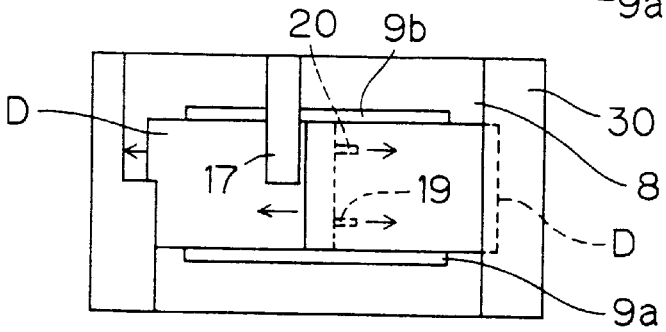
Figure 4:
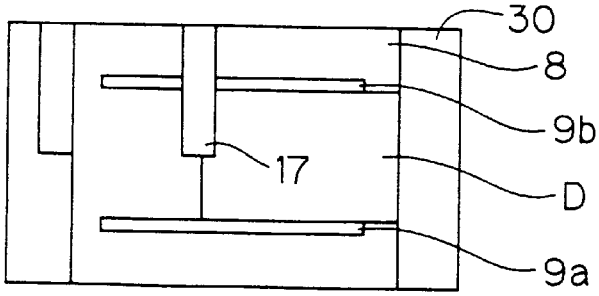
Figure 4:
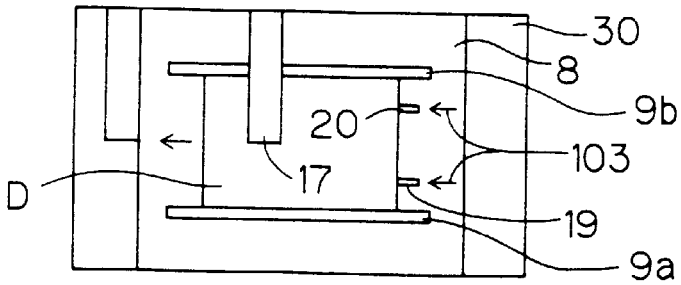

FIGS. 4(*a*) to 4(*e*) are schematic diagrams illustrating an operation of the recycle document feeder.

Referring to FIG. 4(*a*), a user slides the document width regulating guides 9*a* and 9*b* to adjust the spacing therebetween in conformity with the size of document originals to be transported before placing the document originals on the document placing plate 8.

As shown in FIG. 4(*b*) , the stack of document originals D is set between the document width regulating guides 9*a* and 9*b*. At this time, the preset switch 13 (see FIG. 1) is pressed down by the weight of the document originals D thereby to be turned on. As a result, the driving of the feed belts 11 and 12 (see FIG. 1) is started. Thus, the stack of document originals D is set in the predetermined setting position on the document placing plate 8. At this time, the size of the document originals D is sensed.

When the print key 4 (see FIG. 2) provided on the copying machine body 2 is thereafter pressed, the partitioning unit 17 is moved in the direction of an arrow 102 (in the direction opposite to the document transportation direction) from its home position. Further, the action plates 19 and 20 are moved in the direction of an arrow 103 (in the document transportation direction) from their home positions within the document discharge portion 30. Upon completion of the movement of the partitioning unit 17 and the action plates 19 and 20, the partitioning bar 18 of the partitioning unit 17 is lowered to assume the active state, so that the tip of the partitioning bar 18 (see FIG. 1) abuts against the top surface of the stack of document originals D set in the setting position. In parallel to the aforesaid operation, the lowermost one of the document originals D set in place is fed out of the document placing plate 8.

The movement amounts of the partitioning unit 17 and the action plates 19 and 20 are determined by the size of the document originals set in place. More specifically, the partitioning unit 17 is moved to such a position that a distance between the partitioning bar 18 and the downstream edge (left edge in FIG. 4(*b*)) of the document discharge portion 30 virtually equals the length of the document originals D (as measured along the document transportation direction) when the partitioning bar 18 of the partitioning unit 17 is lowered. The action plates 19 and 20 are moved to such positions that the downstream faces thereof are brought in contact with the trailing edges of the document originals D set in the setting position.

Referring to FIG. 4(*c*), a document original first fed back from the document discharge portion 30 after being subjected to the image reading operation for copying thereof advances on the document placing plate 8 with opposite edges thereof guided by the document width regulating guides 9*a* and 9*b*. The leading edge of the document original D first fed back is guided by the action plates 19 and 20 and is rested on the stack of document originals D set in place. Upon the feed-back of the first document original D, the action plates 19 and 20 are retracted to their home positions within the document discharge portion 30, and the document originals D subsequently fed back are guided by the document width regulating guides 9*a* and 9*b* so as to be rested on the first document original D.

Therefore, the document original D fed back onto the document placing plate 8 is prevented from bumping against the trailing edges of document originals D remaining in the setting position, so that the document original D is not folded nor inserted between the document originals D. Since the leading edge of the document original D thus fed back is stopped by the partitioning bar 18, the document original D is not pushed downstream in the document transportation direction by an impetus added thereto when it is discharged from the document discharge portion. The document original thus fed back is divided from the document originals yet to be fed, thereby preventing needless document re-feeding.

Upon completion of the image reading of all the document originals D set in place, the document feeder assumes a state as shown in FIG. 4(*d*). At this time, one set of copies of the document originals is made. Where plural sets of copies of the document originals D are to be made, the partitioning bar 18 is shifted from the state shown in FIG. 4(*d*) to the inactive state, and then the action plates 19 and 20 are moved from their home positions in the direction of the arrow 103. Thus, the trailing edge of the stack of document originals D is pushed by the action plates 19 and 20 so that the document stack is guided by the document width regulating guides 9*a* and 9*b* to be transported in the document transportation direction as shown in FIG. 4(*e*) . When the preset switch 13 is turned on, the stack of document originals D is transported to the setting position by the feed belts 11 and 12, whereby the document feeder assumes a state as shown in FIG. 4(*b*) again to start the second document transportation cycle.

After a required number of copy sets are made, the partitioning bar 18 is retracted within the partitioning unit 17, and then the partitioning unit 17 is returned to its home position. Therefore, the partitioning unit 17 does not hinder the user from removing the document originals D from the document placing plate 8.

Thus, the document width regulating guides 9*a* and 9*b* have the function of positioning the document originals D set on the document placing plate 8 with respect to the direction perpendicular to the document transportation direction (the document widthwise direction) as well as the function of guiding the opposite edges of the document originals D fed back onto the document placing plate 8. Since the document originals D fed back onto the document placing plate 8 are aligned with respect to the document widthwise direction by the document width regulating guides 9*a* and 9*b*, there is no need for additionally providing a mechanism for slightly reciprocating the document width regulating guides perpendicularly to the document transportation direction (in the sliding direction of the document width regulating guides) for alignment of the document originals D, thereby reducing the costs.

In addition, an operation noise is eliminated because the document width regulating guides 9*a* and 9*b* are kept stationary.

However, if the document width regulating guides 9*a* and 9*b* each have a small length as measured along the document original transportation direction in the arrangement adapted to align the document originals D with respect to the width thereof only by the document width regulating guides 9*a* and 9*b*, the document originals D fed back onto the document placing plate cannot properly be aligned by the document width regulating guides 9*a* and 9*b* thereby to be randomly stacked on the skew with respect to the document transportation direction. The document originals D randomly stacked on the document placing plate 8 cannot smoothly be transported by the action plates 19 and 20.

The inventors of the present invention have found that the aforesaid drawback can be overcome by employing an arrangement such that the document width regulating guides 9*a* and 9*b* are adapted to guide a document original fed back onto the document placing plate 8 from the document discharge portion 30 over a distance greater than 50% of the length of a smallest size document original to be possibly transported by the recycle document feeder.

The spacing between the document width regulating guides 9*a* and 9*b* determined by the click mechanisms 200 and 201 for each document size is defined as the width of the document originals D placed on the document placing plate plus a predetermined margin. In consideration that the document originals D are discharged in a slightly skewed state from the document discharge portion 30 and the document originals D have dimensional variations, the margin is employed to ensure that the document originals D can advance between the document width regulating guides 9*a* and 9*b*.

Figure 5:
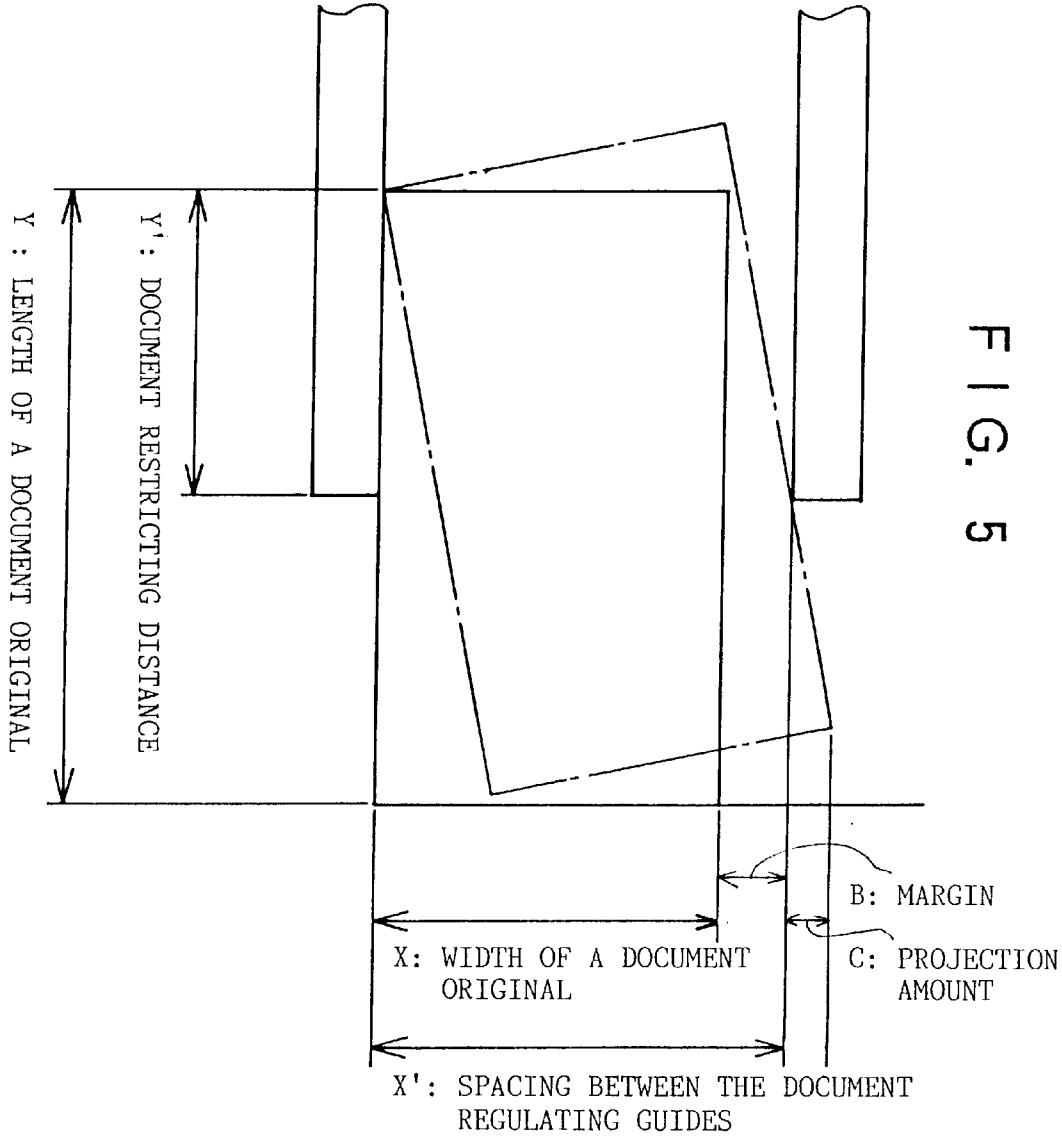
FIG. 5 is a diagram for explaining a document guiding distance over which a document original is guided by document width regulating guides.

With reference to FIG. 5, a more specific explanation will be given to this arrangement. It is herein assumed that the length of a document original D (as measured along the document transportation direction), the width of the document original D, a document restricting distance over which the document original is restricted by the document width regulating guides 9*a* and 9*b* for guidance thereof, and the spacing between the document width regulating guides 9*a* and 9*b* are represented by Y, X, Y' and X', respectively. The spacing X' is adjusted to include a margin B with respect to the document width X. The margin B is herein from 1 mm to 2 mm.

Where the margin B is 2 mm (i.e., X'=X+2 mm), for example, a projection amount C by which the trailing edge of the document original is projected from either one of the document width regulating guides 9*a* and 9*b* is maximized when a document original having the smallest possible length Y is employed as the document original. This is a case, for example, where a B5-size document original is laterally transported.

If the ratio of the document restricting distance Y' to the document length Y is expressed as Z, the ratio Z and the projection amount C have a relationship as shown in the following table.

| Z (Y'/Y) | C (Projection amount) | Evaluation |
|---|---|---|
| 10% | 10.51 mm | Unacceptable |
| 20% | 6.28 mm | Unacceptable |
| 30% | 4.02 mm | Unacceptable |
| 40% | 2.68 mm | Unacceptable |
| 50% | 1.82 mm | Unacceptable |
| 60% | 1.22 mm | Acceptable |
| 70% | 0.78 mm | Acceptable |
| 80% | 0.44 mm | Acceptable |
| 90% | 0.18 mm | Acceptable |

In the examination of the relationship between the ratio Z and the projection amount C, the resulting inconveniences were evaluated, and the evaluation results are shown in the table. It was experimentally confirmed that, when the projection amount C was great, a projected portion of the document original was folded and a driving load for document transportation was increased thereby to cause document transportation failures.

In consideration that the spacing between the document width regulating guides 9*a* and 9*b* is defined as the document width X plus the margin B, the inventors of the present invention have reached a conclusion that the document width regulating guides 9*a* and 9*b* are preferably constructed such that the document original D fed back onto the document placing plate 8 is guided over a distance equivalent to or greater than 60% of the length of the document original D as measured along the document transportation direction.

With the document width regulating guides 9*a* and 9*b* having such a construction, the document originals D once subjected to the transportation operation and fed back onto the document placing plate can assuredly be aligned with respect to the width of the document originals D, and smoothly transported to the predetermined setting position.

As described above, the slide mechanism 35 for sliding the document width regulating guides 9*a* and 9*b* includes the plurality of click mechanisms which are spaced a predetermined distance in the document transportation direction. Therefore, the document width regulating guides 9*a* and 9*b*, even if having a great length, can be kept parallel to each other.

What is claimed is:

1. A recycle document feeder which is adapted to feed document originals previously set on a document placing plate one by one into a document transportation path and transport the document originals one by one through the transportation path and then back onto the document placing plate, the recycle document feeder comprising:

a pair of document width regulating guides provided on the document placing plate in an opposed relation and each extending parallel to a document transportation direction for positioning the document originals placed on the document placing plate with respect to a direction perpendicular to the transportation direction and guiding the document originals fed back onto the document placing plate, wherein the pair of document width regulating guides is adapted to guide the document originals fed back onto the document placing plate over a distance equivalent to or greater than 60% of the length of a smallest size document original to be possibly transported by the document feeder, and a partitioning unit which is reciprocally movable in the document transportation direction for stopping leading edges of the document originals fed back onto the document placing plate.

2. A recycle document feeder as set forth in claim 1, wherein the pair of document width regulating guides are movable toward and away from each other in a direction of the width of the document originals in an interlocked relation along rails provided on the document placing plate.

3. A recycle document feeder as set forth in claim 2, wherein the pair of document width regulating guides can manually be moved so that a spacing therebetween is adjusted to conform to the width of the document originals placed on the document placing plate.

4. A recycle document feeder as set forth in claim 1, wherein the partitioning unit is provided above the document placing plate.

5. A recycle document feeder as set forth in claim 1, wherein the partitioning unit includes a partitioning bar which is shifted between an inactive state where it is retracted within the partitioning unit and an active state where it projects from the partitioning unit to stop the leading edges of the document originals fed back onto the document placing plate.

6. A recycle document feeder as set forth in claim 1, further comprising:

document size sensing means for sensing the size of the document originals placed on the document placing plate, wherein the partitioning unit is moved to a predetermined position which depends on the size of the document originals sensed by the document size sensing means when document transportation is started.

7. A recycle document feeder as set forth in claim 1, further comprising an action plate reciprocally movable in the document transportation direction on the document placing plate and adapted to guide, at least when a document original first transported is fed back onto the document placing plate, the document original in such a manner that a leading edge thereof is directed toward an upper side of trailing edges of document originals remaining on the document placing plate and, after the document originals previously set on the document placing plate are all subjected to a document transportation cycle and fed back onto the document placing plate, push trailing edges of the document originals fed back onto the document placing plate to transport the document originals toward a transportation starting position.

8. A recycle document feeder as set forth in claim 7, wherein the action plate is of a generally right-angled triangular shape having an edge inclined upward in the document transportation direction as viewed horizontally and perpendicularly to the document transportation direction.

* * * * *